US006726015B2

(12) United States Patent
Hulick

(10) Patent No.: US 6,726,015 B2
(45) Date of Patent: Apr. 27, 2004

(54) MEDICANT PACKAGE

(75) Inventor: Martin E. Hulick, Warrington, PA (US)

(73) Assignee: Sharp Corporation, Conshohocken, PA (US)

( * ) Notice: Subject to any disclaimer, the term of this patent is extended or adjusted under 35 U.S.C. 154(b) by 148 days.

(21) Appl. No.: 10/114,867

(22) Filed: Apr. 1, 2002

(65) Prior Publication Data

US 2003/0183551 A1 Oct. 2, 2003

(51) Int. Cl.[7] ..... B65D 83/04
(52) U.S. Cl. ..... 206/531; 206/468
(58) Field of Search ..... 206/461, 467, 206/468, 471, 528, 531–534, 538, 539, 232

(56) References Cited

U.S. PATENT DOCUMENTS

| | | | | |
|---|---|---|---|---|
| 1,984,351 | A | 12/1934 | Johnson | |
| 2,199,476 | A | 5/1940 | Berg | |
| 4,485,920 | A | 12/1984 | Skylvik | 206/468 |
| 4,506,789 | A | 3/1985 | Dlugosz | 206/532 |
| 5,088,603 | A | 2/1992 | Kirkpatrick | |
| 5,244,091 | A | 9/1993 | Tannenbaum | |
| 5,297,679 | A | 3/1994 | Rondone et al. | 206/468 |
| 5,529,188 | A | 6/1996 | Coggswell | 206/531 |
| 5,613,609 | A | 3/1997 | Hamilton et al. | 206/531 |
| 5,915,559 | A | 6/1999 | Hulick et al. | |
| 6,024,222 | A | 2/2000 | Friberg et al. | |
| 6,394,275 | B1 | 5/2002 | Paliotta et al. | 206/531 |

*Primary Examiner*—Luan K. Bui

(57) ABSTRACT

This invention includes an improved child-resistant medicant package. The package may be in the form of a card that has a first page connected by a fold line to a second page. The second page may have a first and a second side with a moveable member mounted in between the first and the second pages. Disposed on the moveable member and extending from the member are one or more blisters that are separated by a raised area. A medicant can be disposed within each blister. A tab and is connected to the first side by perforations, such that the member cannot be moved unless the tab is separated from the first side. Disposed in the second side of the second page are a pair of holes that are not in registry with the blisters so that access to the medicant is prevented. When the tab is separated from the first side, the moveable member can be moved to place the first blister in registry with the first hole, and the second blister in registry with the second hole, such that the medicants can be accessed by punching them through a barrier beneath the blister and the first and second holes.

27 Claims, 4 Drawing Sheets

FIG.1
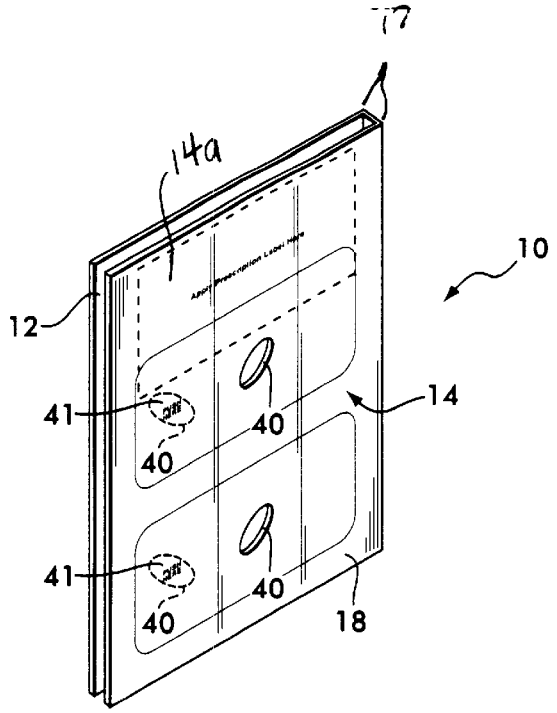
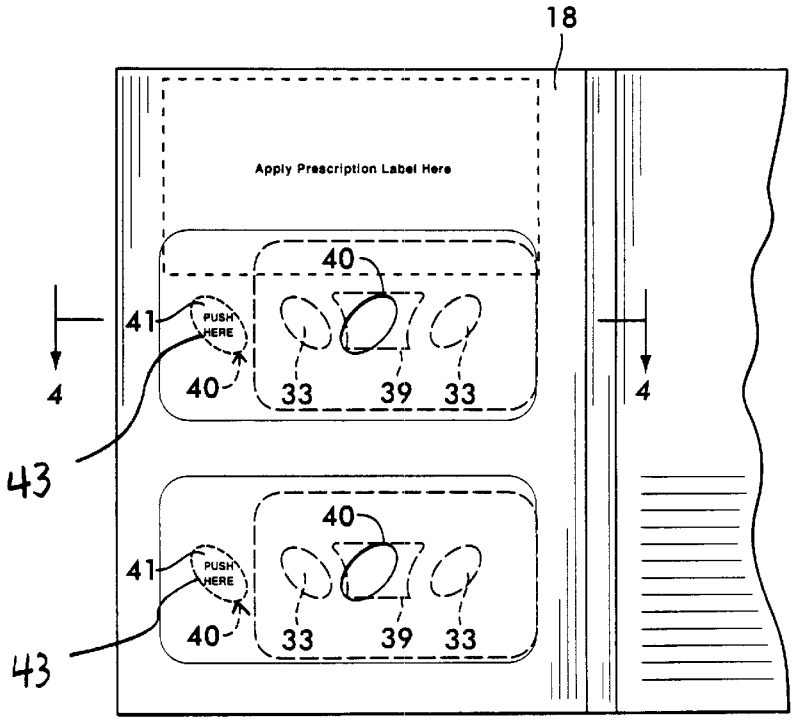
FIG.3

FIG.4
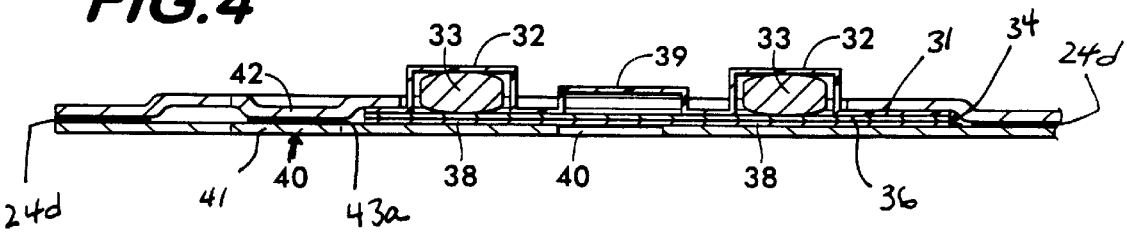
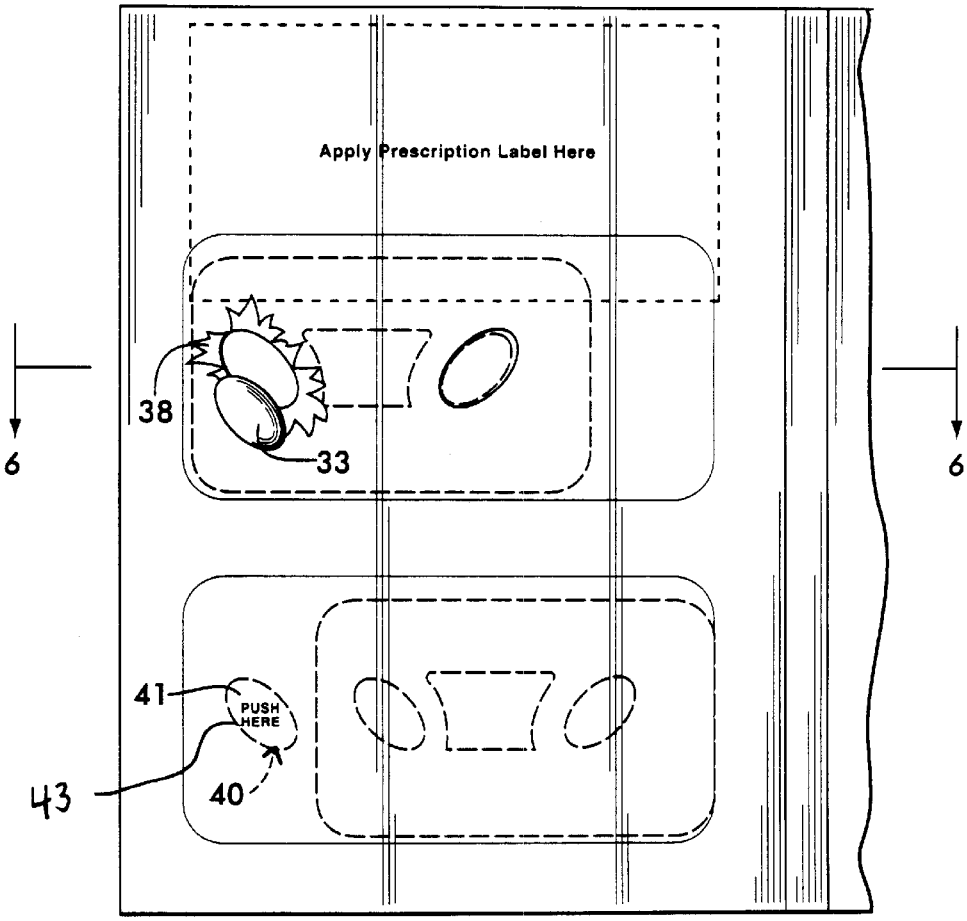
FIG.5

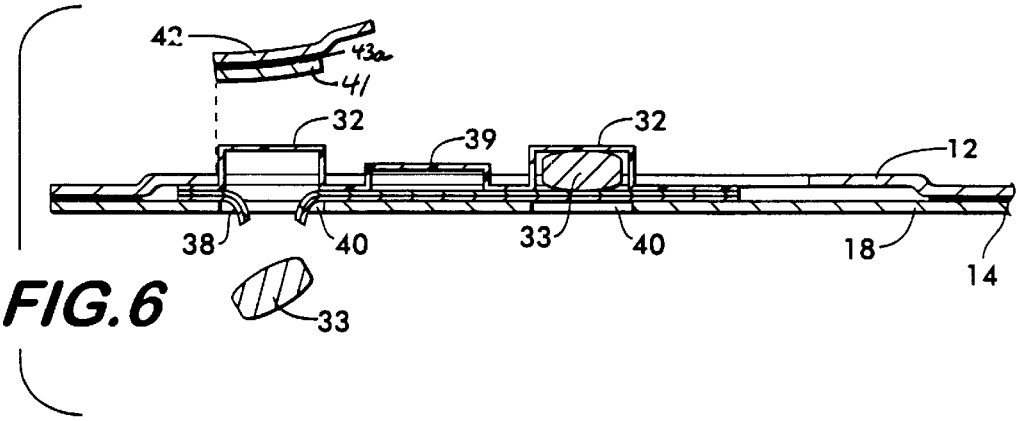
FIG.6
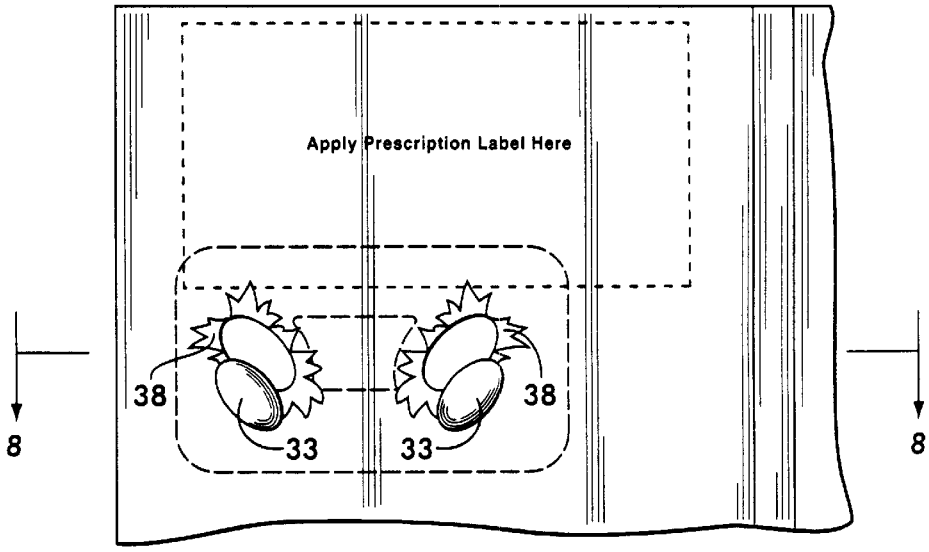
FIG.7
FIG.8
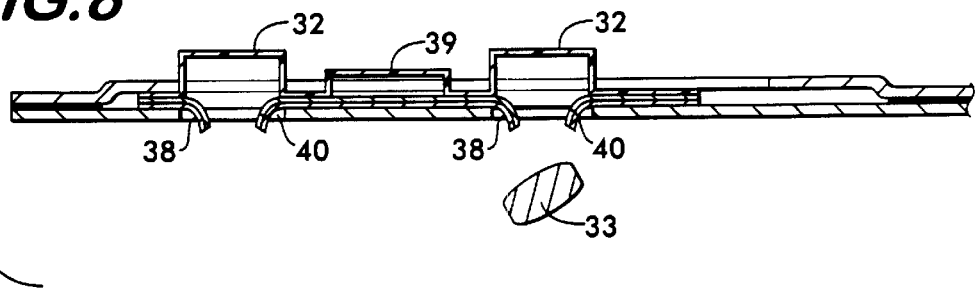

MEDICANT PACKAGE

FIELD OF THE INVENTION

This invention relates to an improved child resistant ("CR") medicant packaging.

BACKGROUND OF THE INVENTION

Because medicants can have serious consequences for those not authorized to use them, medicant packaging has been designed to prevent children from gaining access to the medicant. As an example, tear-resistant blisters have been designed that house medicants. Because the blisters are tear resistant it is difficult for children to gain access to the medicant. Other child resistant packaging includes packaging which is itself tear resistant except when torn in a certain direction. A notch or other mark is used to indicate the place where the package should be torn to gain access to the medicant. This invention relates to an improved child-resistant package for housing medicants.

SUMMARY OF THE INVENTION

This invention includes a medicant package that has improved child resistance or safety features that prevent children or others who should not have access to the medicant from gaining access to the medicant. The medicant package of this invention preferably has several features that prevent accidental or unauthorized access. These features include in various embodiments one or more of the following: a tear resistant blister that houses a medicant, a hole through which the blister medicant can be accessed that is not aligned with the blister and requires moving the blister into alignment with the hole in order to remove the medicant; and a perforated tab that prevents moving the blister into alignment with the hole.

In an embodiment, the medicant package includes a first side and a second side that are connected such that there is a cavity defined between the two. There is also a first and a second hole disposed in the second side. A moveable member is disposed between the first and the second sides. The moveable member has a first and a second blister in which a first and a second medicant can be stored.

The package also has a tab having at least a portion which is perforated and attached by the perforations to the first side. The perforated tab is disposed such that when the tab is in place the tab prevents substantial movement of the moveable member. In this position the blisters are not aligned with the second side holes. Thus, access to the medicants is limited by the tear resistant blisters and the tab which prevents aligning the blisters with the holes.

In order to gain access to the medicant, the perforated tab is separated from the front side by tearing the perforations. Once separated from the front side, a path is created for the moveable member, and the movable member can be moved to place the first blister in registry with the first hole in the second portion. The user can apply a force to the blister and the medicant and punch the medicant through a barrier layer beneath the medicant and through the first hole, thereby removing the medicant from the package. This barrier provides yet another safety feature.

In another embodiment, the moveable member can have a plurality of blisters, and each blister can be aligned with a hole when the moveable member is moved. It will be appreciated that the package could have any number of blisters.

Another safety feature of this invention is orienting, sizing, and shaping the hole to the orientation, size and shape of the blister, which is preferably oriented, sized, and shaped to the medicant housed by the blister. This safety feature acts as protection in the event that the perforated tab is removed by a child, and the child moves the medicant and blister into registry with the hole. If a child does this, the child will have difficulty removing the medicant because the hole is oriented, sized, and shaped to that of the medicant. A bigger hole, although it can be used where not specifically claimed herein, would increase the likelihood that a child would gain access to the medicant.

Other features of the invention are described below. It will be appreciated that the preferred embodiment of this invention has many safety features, but the claimed invention only employs those features which are so claimed.

BRIEF DESCRIPTION OF THE DRAWINGS

FIG. 1 is a perspective view of medicant package according to a preferred embodiment of this invention;

FIG. 3 is a plan view of a portion of the medicant package of FIG. 1;

FIG. 4 is a cross-section taken along line 4—4 of FIG. 3;

FIG. 5 is a plan view of a portion of the medicant package of FIG. 1 with a medicant being removed from the package;

FIG. 6 is a cross-section taken along line 6—6 of FIG. 5;

FIG. 7 is a plan view of a portion of the medicant package of FIG. 1 with two medicants being removed from the package; and FIG. 8 is a cross-section taken along line 8—8 of FIG. 7.

DETAILED DESCRIPTION OF PREFERRED EMBODIMENTS

Figure 2:
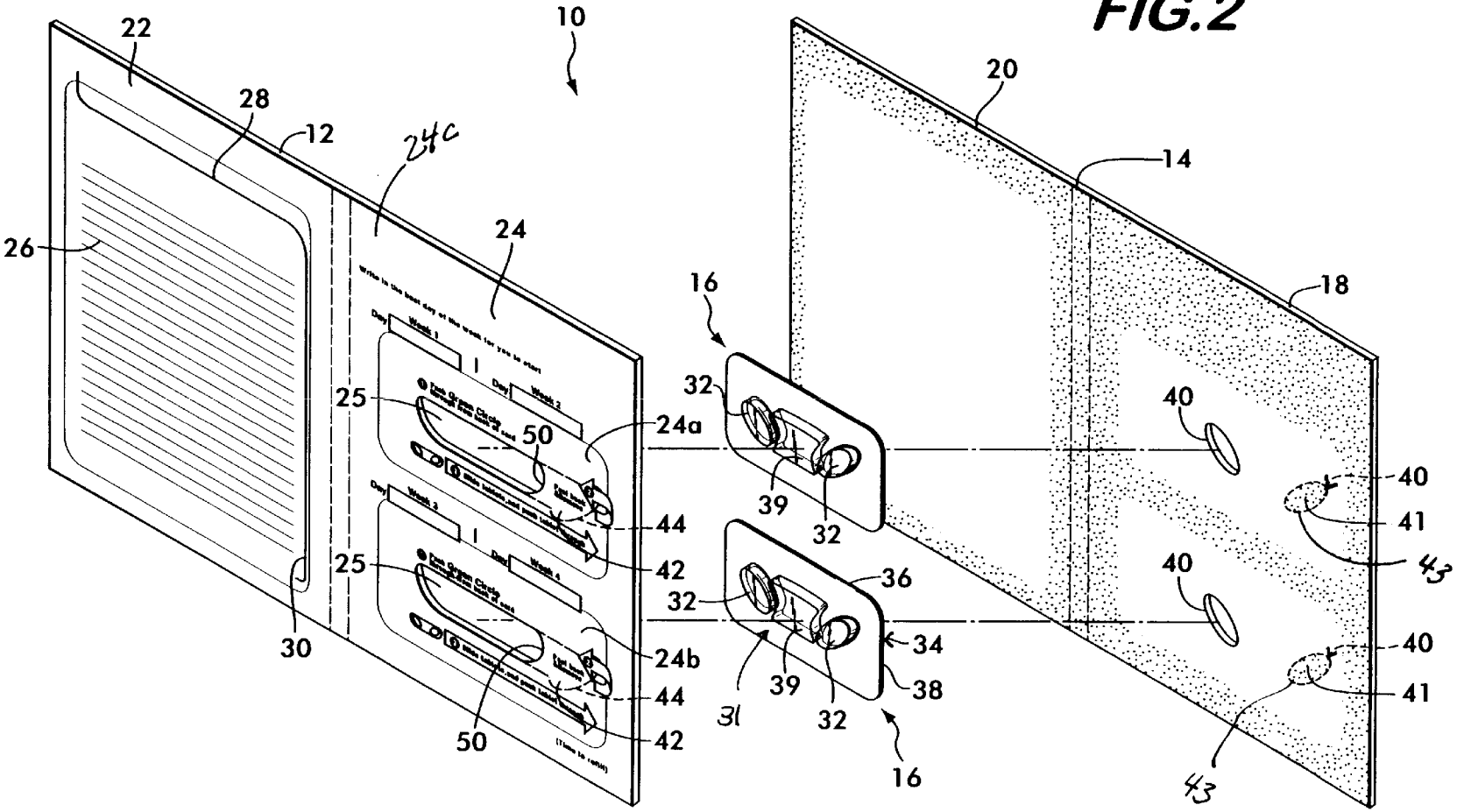
FIG. 2 is an assembly drawing of the medicant package of FIG. 1.

This invention relates to an improved child-resistant medicant package that has improved safety features that prevent children or those that should not have access to the medicant from gaining access to the medicant. The safety features include a blister that houses the medicant, a requirement that the blister be moved to remove the medicant from the package, and preventing the movement of the blister until movement of the blister is desired.

FIG. 1 is a perspective view of a preferred embodiment of the medicant package 10 folded in half, and FIG. 2 is an assembly drawing of the embodiment of FIG. 1. The medicant package 10 includes a first portion 12 and a second portion 14 as best understood by reference to FIG. 2. Also include within the medicant package 10 are one or more blister packs 16. The first portion 12 and the second portion 14 are preferably paper, paperboard, or card board. They can be attached together by any suitable means including, but not limited to, by adhesives or mechanical means. The first and the second portions may have fold lines 17 along which they can be folded in half as shown in FIG. 1.

When folded in half, the package takes the form of a card that has an inside. As will be appreciated from viewing FIGS. 1 and 2, the package first portion 12 defines the inside of the card, and the package second portion 14 defines the outside of the card. In fact, the package second portion 14 defines a back cover 18 and a front cover 20, and the package first portion 12 defines a first inside page 22, and a second inside page 24, as shown in FIG. 2. FIG. 1 depicts the package folded in half such that the back cover 18 is shown.

It will be appreciated that the card could likewise be folded along the fold line in the opposite direction from that shown in FIG. 1 so that the inside of the card is exposed. A card is only an embodiment of this invention, and the package's child-resistant features of this invention need not be in the form of a card. Moreover, it will be appreciated that except where limited so by the claims, the package of this invention can be practiced without a portion that folds over to cover another portion. For example, a card having portions 18 and 24 attached together and not having portions 12 and 20 can be used.

Although not required to practice the invention, the first inside page 22 may have an area 26 that may be printed. For example, a doctor's instructions, graphics, comments, pharmacists instructions, or comments can be written here. Further, the area 26 may be separated on two sides 28, 30 from the remaining part of the first portion 12 to define a pocket, so that papers or other relatively thin items can be inserted between the area 26 and the second portion 14 and retained therein. For example, a doctor's instructions may be held by the pocket.

Disposed on the second inside page 24 may be printed instructions for taking the medication, instructions for removing the medicant, places to write the dates on which the medicant has been or needs to be taken, and any other printed text or graphics that is desired. It will be appreciated that if aspects of the invention are practiced without a card, the notes and the instructions on the inside pages 22, 24 can be placed in any other area of the package first and second portions 12, 14. Moreover, aspects of this invention can be practiced without the pocket or the printed material. Also formed in the second inside page 24 are openings 25 through which blisters extend when assembled between the first and second portions as understood with reference to FIG. 2 and as explained in more detail below.

The second inside page 24 may also have raised portions 24*a*, 24*b* that are raised or slightly elevated relative to the remaining portion 24*c* of the inside second page 24. The blister packs described below are fit between the raised portions 24*a*, 24*b* and the back cover. When the first portion 12 and the second portion 14 are assembled, adhesive 24*d* (FIG. 4) is preferably used in the areas between the first and second portions 12, 14 outside of the raised portions 24*a*, 24*b*. Thus, the blister packs described below are inserted between the raised portions and the back cover and are free to move in this portion but are constrained from moving outside of the area underneath the raised portions by the first and second portions that are adhered together. Although raised portions 24*a*, 24*b* are used in a preferred embodiment of this invention and do not form part of the invention except where so expressly claimed. The raised portions make it easier to move the blister pack between the first and second portions 12, 14.

The second portion 14 may also have a text area including but not limited to that defined in FIG. 1. As shown in FIG. 1, the second portion 14 may have printed dashed lines 14*a* and text that states "Apply Prescription Label Here." This provides an area to attach a prescription so that the user can retain the prescription with the medicants. The features of this paragraph describe a commercial embodiment and need not be part of the claimed invention.

FIG. 2 depicts two blister packs 16. This invention can be practiced with any number of blister packs 16, and two are shown by way of example. Although only one of the blister packs is described below, it will be appreciated that the other blister pack is substantially identical. The blister packs 16 preferably include a blister layer 31 which is disposed over a base 34, as is best shown in FIG. 4. The blister layer defines the top of the blisters 32 and is preferably a vinyl or PVC material, but can be any suitable material. As will be appreciated from the following description, the blister pack 16 can have any number of blisters 32, and in the preferred embodiment shown the blister pack 16 has two blisters 32. Each blister 32 is preferably constructed from a transparent or opaque formable barrier film or foil that is tear resistant, such that a medicant housed in the blister cannot be accessed by tearing the blister without substantial effort or the use of a blade. The blisters 32 are preferably, but need not be, transparent so that the medicant housed by the blister can be seen. Although the blisters 32 can take any orientation, size or shape, the blisters 32 are preferably oriented, sized, and shaped to correspond to the orientation, size, and shape of the medicant 33. For example, in the embodiment shown the blister 32 is oblong for housing a generally oblong medicant, and the blister is slightly larger than the medicant, so that the medicant will fit within the blister 32 but will not be able to have a significant amount of room to move.

As referred to above, the blister pack 16 may also have a base 34 to which the blister layer 31 is attached by any suitable means including but not limited to adhesives. Although the base 34 may take a variety of forms, and use any suitable materials the base has in a preferred embodiment a first layer 36 and a second layer 38, as shown in FIG. 4. These layers 36, 38 can also be attached by any suitable means including but not limited to adhesives. The base may be constructed from a single material; the choice of two materials is a preference.

Any suitable material can be used for the layers 36, 38. Preferably, the first layer 36 is a metal foil, and the second layer 38 is a material through which a medicant can be punched such as paper. The first layer 36 may have a plurality of dimples disposed on its surface to facilitate the attachment of the other layers to it. It will be appreciated that a medicant can be removed from a blister 32 by pushing the blister and forcing the medicant to punch a hole in the first and second layers 36, 38, so that the medicant can be removed via the punched hole.

The blister pack 16 may also have a blister or raised area 39 that does not house a medicant, but rather acts as a separator between the two blisters 32 that do house medicants and provides additional protection against accessing the medicants. This blister 39 can be defined by the blister layer 31. The blister 39 prevents a child from tearing the card by putting his fingers between the blister package 16, tearing the card and then separating the blister pack 16 from the card. The blister 39 is likewise preferably a transparent or opaque formable barrier film or foil. This function of this blister 39 can also be accomplished by having the blisters 32 close enough to prevent a child from putting his fingers between them. The blister 39 is preferably tear resistant so that if one blister 32 is opened or a medicant is punched out of one of the blisters, the second blister 32 cannot be accessed easily. It would take significant effort or a blade to cut through the separating blister 39 to reach one of the medicants. As will be appreciated from viewing FIG. 2, the blister 39 is preferably of substantially the same height as the opening in the front cover 12 that the blister 39 extends through.

As shown in FIG. 2, the package second portion 14 preferably has a plurality of holes 40. Preferably, there is a hole 40 for each medicant blister 32, and there can be any number of holes and blisters. Preferably, the holes 40 are oriented, sized and shaped to correspond to the blister's orientation, size and shape-the blister is oriented, sized and shaped to the medicant. Orienting, sizing and shaping the holes to correspond to the blister provides child-resistance. It reduces the likelihood of a medicant being removed from the package 10 unless the blister is precisely aligned with a hole 40. If desired, the holes may be covered with a perforated tab 41 which is connected by perforations 43 to the back cover as shown in FIGS. 2 and 3. Although only one hole is shown as covered with a tab 41, it will be appreciated that the others hole could likewise have such a cover. As will be understood from the explanation below, the medicants can be aligned with the tab 41 and can be punched out to remove a medicant. Although the tab 41 may be labeled with instructions such as "push here" indicating the area through which the medicant should be pushed, the tab 41 need not be so labeled.

From the assembly drawing of FIG. 2, it will be understood that when the package 10 is assembled, the blister pack's blisters 32 are not aligned with the back cover holes 40. This is also best understood with reference to FIG. 3. FIG. 3 depicts a plan view of the back cover with the medicants installed in the blister pack. The blisters are shown in dashed lines because they are on the other side of the back cover. As shown, the blisters do not align with the holes 40. Thus, when assembled the medicants are not accessible except by destroying the relatively impregnable blisters or by ripping open the card and the blister pack.

Another safety feature of this invention includes a means for preventing movement of the blisters to place them in registry with the holes 40. In the embodiment shown, this means includes a tab 42 which is connected by perforations 44, shown as dashed lines in FIG. 2, to the first portion 12.

The tab 42 is in a preferred embodiment attached to the tab 41 in the back cover, as best understood with reference to FIG. 4. The tabs 41 and 42 can be attached by an adhesive 43*a*, shown in black in FIG. 4. Tab 42 is also preferably attached by perforations to the front cover. When the tab 42 is connected to the first portion 12, the tab 42 prevents moving the blisters in registry with the holes 40. The right most blister shown in FIG. 2 will abut against the left side of the tab 42 to prevent movement of the blister to the right and placing the blisters in registry with the holes 40. Movement of the blister pack to the left is also prevented by the end of the raised portion 24*b* that defines the left side of the opening. The left most blister contacts the end of the raised portion—where the first and second portions are sealed together—so that the blister's movement to the left is constrained. Likewise, the blister's vertical movement is constrained by the vertical portions that define the opening—again where the raised portions 24*a*, 24*b* end and the first and second portions are sealed. The blisters 32 contact these portions to prevent any significant movement of the blister pack. Thus, the blister packs are also constrained from moving by the first portions and the second portions 12, 14 that are adhered together. When the tab 42 is separated as described below, the adhesion of the first and the second portions will prevent movement of the blister pack to the left as viewed in FIG. 4 (the right in FIG. 2) right beyond that desired. The tab 42 may be labeled as shown in FIG. 2 with instructions such as those shown "Peel Back & Remove." Although the drawings show the tabs 41, 42 being removed from the front side, it will be appreciated that they can be removed from the back side.

The left portion 50 of the tab 42 may be shaped to conform to the orientation, size and shape of the blister, which is oriented. sized, and shaped to the medicant. This prevents movement of the blister pack to the right. In a preferred embodiment the right side of the blister is oval shaped, but it can be other shapes. In the embodiment shown, the left portion 50 is oriented, sized, and shaped to conform to the blister.

The package 10 has in a preferred embodiment three primary safety features, the blisters, the requirement to move the blisters in registry with the holes, and the safety tab which prevents movement of the blisters into registry with the holes. (The claims of course need only include those features so claimed.) The operation of these safety features and the removal of the medicants will now be described primarily with reference to FIGS. 3–8. FIGS. 3, 5, and 7 are plan views of the back cover and show the hidden blisters with perforated lines. FIGS. 4, 6, and 8 are cross-sections that respectively correspond to FIGS. 3, 5, and 7. These Figures depict the different positions of the blisters and the removal of the blisters.

The package is assembled as shown in FIGS. 3 and 4. The tabs 41 and 42 are in place, as depicted in FIG. 4, and the blisters are not in registry with the holes 40, as is also depicted in FIGS. 3 and 4. Thus, all of the safety features—the blisters, the need to register the blisters with the holes, and the tab preventing registry—are operable. In order to access a medicant, the user separates the tabs 41 and 42 from the perforations and the first portion 12 and the back cover 14, as shown in the cross-section of FIG. 6. After the tabs 41 and 42 are removed, the user engages a blister 32 and moves the blister pack from the position shown in FIGS. 3 and 4 to the positions of FIGS. 5 and 6. As shown, the blister pack has moved within the spaced defined between the first 12 and second portions 14. Once moved, the blisters 32 in the blister pack are aligned with the holes 40 in the second portion. By pushing on the left most blister, the medicant can be forced through the first and second layers 36, 38 beneath the blister and the first hole, as shown in FIG. 6. FIGS. 5 and 6 show the layers 36, 38 of the blister pack being punched out and the medicant 33 falling through the hole 40. The user can also remove the second medicant at the desired time by pushing the other blister and punching the other medicant through the barrier beneath the blister as shown in FIGS. 7 and 8. It will be appreciated that the other medicants housed in the other blister pack shown in FIG. 2 can likewise be removed in a similar way.

It will be appreciated that tabs 41 and 42 need not be attached. If they are not, the user removes the perforated tabs 41 and 42 separately. It will be appreciated that this invention can have other embodiments, including for example a blister pack that is rotatable to align blisters with holes. It will also be appreciated that the package could have any number of medicants, blisters, and blister holes. Moreover, the blister and blister holes could be aligned such that they move multiple times in order to align each blister with a hole. For example, a first movement of a blister pack would align a first medicant with a hole, a second movement would align a second medicant with a blister hole, and this pattern could be repeated for the desired number of medicants.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A medicant package, comprising:

a first side and a second side;

a first opening disposed in the second side;

a moveable member mounted between the first and the second sides;

a first blister mounted on the moveable member in which a first medicant can be stored;

a tab having at least a portion which is perforated and attached by the perforations to the first side such that when the tab is in place the tab prevents substantial movement of the moveable member, and when the tab is separated from the front side by tearing the perforations a path is created for the moveable member and the movable member can be moved to place the first blister in registry with the first opening so that the medicant can be removed through the first opening.

2. The medicant package of claim 1, further comprising a second hole disposed in the second side and a second blister mounted on the moveable member in which a second medicant can be stored; such that when the moveable member is moved the second blister is moved into alignment with the second hole.

3. The medicant package of claim 2, wherein the moveable member comprises a third blister that separates the first and the second blisters.

4. The medicant package of claim 1, wherein the package comprises a card and the first and the second sides are sides of a second page connected by a fold line to a first page that folds to cover the first side of the second page.

5. The medicant package of claim 1, wherein the first hole is shaped and sized to the shape and size of the first medicant that is to be housed by the first blister.

6. The medicant package of claim 1, wherein the moveable member comprises a foil layer that is disposed over a paper layer, such that the medicant housed by the first blister can be punched through the foil and paper layers and the first hole to remove the medicant.

7. The medicant package of claim 1, wherein the first blister is oblong shaped.

8. The medicant package of claim 1, further comprising a perforated member that covers the first hole, is attached to the second side by perforations, and is removed by separating the perforated member from the second side.

9. The medicant package of claim 8, wherein the perforated member is attached to the tab and the perforated member and the tab are removed together.

10. The medicant package of claim 1, wherein the first side and the second side are attached by an adhesive in an area that surrounds the moveable member.

11. A medicant package, comprising:

a first side;

a second side having a first hole;

a moveable member disposed in between the first and the second sides of the package;

a blister mounted on the moveable member, the blister being for housing a medicant and not being aligned with the first hole until the moveable member is moved to align the blister with the first hole; and a perforated tab extending from the moveable member that is connected by perforations to the first side such that the moveable member can only be moved when the tab is separated from the first side.

12. The medicant package of claim 11, further comprising a second hole disposed in the second side and a second blister disposed on the moveable member, the blister being for housing a medicant and not being aligned with the second hole until the moveable member is moved to align the blister with the second hole.

13. The medicant package of claim 12, wherein the first and the second holes are aligned in a row.

14. The medicant package of claim 11, wherein the package comprises a card and the first and the second sides are sides of a second page connected by a fold line to a first page that folds to cover the first side of the second page.

15. The medicant package of claim 11, wherein the first hole is shaped and sized to the shape and size of the first medicant that is to be housed by the first blister.

16. The medicant package of claim 11, wherein the first side and the second side are attached by an adhesive in an area that surrounds the moveable member.

17. The medicant package of claim 11, wherein the moveable member is slidable.

18. The medicant package of claim 11, further comprising a perforated member that covers the first hole, is attached to the second side by perforations, and is removed by separating the perforated member from the second side.

19. The medicant package of claim 18, wherein the perforated member is attached to the tab and the perforated member and the tab are removed together.

20. A medicant package, comprising:

a first side;

a second side having a first hole and being attached to the first side such that there is a cavity defined between the first and the second sides;

a moveable member disposed in the cavity between the first and the second package sides, the moveable member comprising a barrier layer;

a blister mounted on the moveable member barrier layer such that there is a barrier beneath the blister through which a medicant housed by the blister can be punched, the blister not being aligned with the first hole until the moveable member is moved to align the blister with the first hole; and a perforated tab extending from the moveable member that is connected by perforations to the first side such that the moveable member can only be substantially moved when the tab is separated from the first side.

21. The medicant package of claim 20, further comprising a second hole disposed in the second side and a second blister disposed on the moveable member, the blister being for housing a medicant and not being aligned with the second hole until the moveable member is moved to align the blister with the second hole.

22. The medicant package of claim 20, wherein the package comprises a card and the first and the second sides are sides of a second page connected by a fold line to a first page that folds to cover the first side of the second page.

23. The medicant package of claim 20, wherein the first hole is shaped and sized to the shape and size of the first medicant that is to be housed by the first blister.

24. The medicant package of claim 20, further comprising a perforated member that covers the first hole, is attached to the second side by perforations, and is removed by separating the perforated member from the second side.

25. The medicant package of claim 24, wherein the perforated member is attached to the tab and the perforated member and the tab are removed together.

26. A method of removing a medicant from a medicant package having a first side and a second side, comprising:

tearing a perforated tab attached to the package first side that prevents moving a blister housing a medicant into alignment with a hole in the package second side;

moving the blister to align the blister with the first hole; and punching the medicant through a layer beneath the blister and through the first hole to remove the medicant from the package.

27. The method of claim 21, further comprising removing a perforated member that covers the first hole when punching the medicant through the layer.

* * * * *